US007281828B2

(12) United States Patent
Steinhart et al.

(10) Patent No.: US 7,281,828 B2
(45) Date of Patent: Oct. 16, 2007

(54) HEADLIGHTS FOR VEHICLES

(75) Inventors: Ralf Steinhart, Reutlingen (DE); Michael Scholl, Gomaringen (DE); Friedemann Schlienz, Stuttgart (DE); Silke Barton, Reutlingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 235 days.

(21) Appl. No.: 10/898,317

(22) Filed: Jul. 26, 2004

(65) Prior Publication Data

US 2005/0036332 A1 Feb. 17, 2005

(30) Foreign Application Priority Data

Jul. 29, 2003 (DE) ..... 103 34 479.9

(51) Int. Cl.
*F21V 7/00* (2006.01)

(52) U.S. Cl. ..... 362/516; 362/214; 362/507

(58) Field of Classification Search ..... 362/507, 362/211, 214, 305, 306, 310, 516
See application file for complete search history.

(56) References Cited

U.S. PATENT DOCUMENTS 4,523,262 A * 6/1985 Shinkai ..... 362/214
5,111,368 A * 5/1992 Suzuki et al. ..... 362/510
5,857,764 A * 1/1999 Tabata et al. ..... 362/214
6,644,828 B2 * 11/2003 Kinouchi ..... 362/214

FOREIGN PATENT DOCUMENTS

| | | |
|---|---|---|
| DE | 34 08 718 | 9/1985 |
| DE | 35 33 117 | 3/1987 |
| DE | 196 16 037 | 10/1997 |

* cited by examiner

*Primary Examiner*—John Anthony Ward
(74) *Attorney, Agent, or Firm*—Paul Vincent

(57) ABSTRACT

The invention concerns vehicle headlights with two light functions, comprising a reflector (10) and a two-filament bulb (14), whose first spiral-wound filament (14') generates a first light function and whose second spiral-wound filament (14") generates a second light function, each light function being associated with a region (10', 10") of the reflector (10), wherein the second spiral-wound filament (14") cooperates with a covering cap (18) which shields a portion of the light for the light function associated with this spiral-wound filament, which would otherwise impinge on the region (10') of the reflector (10) which is associated with the first light function, wherein the second spiral-wound filament (14") generates a turning and/or curve light and the regions (10', 10") of the reflector (10) are separated by a separating line (12) which extends in a segment of the reflector at an angle of between ±0 and 35°, in particular ±15 and 35°, with respect to the vertical line.

12 Claims, 2 Drawing Sheets

HEADLIGHTS FOR VEHICLES

This application claims Paris Convention priority of DE 103 34 479.9 filed Jul. 29, 2003 the complete disclosure of which is hereby incorporated by reference.

BACKGROUND OF THE INVENTION

The invention concerns a headlight for vehicles with two light functions, comprising a reflector and a two-filament bulb, whose first spiral-wound filament generates a first light function and whose second spiral-wound filament generates a second light function, each light function being associated with a region of the reflector, wherein the second spiral-wound filament cooperates with a covering cap which shields a portion of the light associated with the light function of this spiral-wound filament, which would otherwise impinge on the region of the reflector which is associated with the first light function.

DE 35 33 117 C2 discloses a vehicle headlight for both a fog light and a full beam having a two-filament bulb, with one spiral-wound filament thereof generating the high beam and the other spiral-wound filament generating the fog light. An asymmetrical covering cap is provided and the reflector is horizontally divided into two sections. The lower section can be pivoted relative to the upper section, permitting generation of two separate light beams which meet the legal specifications.

DE 196 16 037 A1 shows a similar design which discloses a headlight for vehicles for the low beam and the high beam, wherein the reflector is divided into an upper and a lower light range, with both reflector regions being used for the low light beam and an upper light/dark border is formed. The light emitted by the second luminous body is reflected by at least one reflector region to form a large range high beam. The covering cap is thereby also disposed above the luminous body which generates the high beam.

DE 34 08 718 C2 also discloses a vehicle headlight with a main and a secondary filament which are disposed in the longitudinal direction on the axis of a reflector, with a shielding plate below the secondary filament, wherein the reflector comprises a portion disposed above the reflector axis and having the shape of a first paraboloid half, and a portion disposed below the reflector axis and having the shape of a second paraboloid half, which are mutually offset on a fixed transition line such that the foci of the two halves are mutually displaced.

In recent years, the desire to improve the illumination of the road has increased, in particular, for curvy roads. For this reason, various attempts have been made to provide a tracked curve light or a static turning light. Such efforts are substantially realized using separate reflectors and light sources which further reduces the already limited space in the headlight housing caused by inclusion of all technical light specifications.

It is therefore the underlying purpose of the invention to improve a vehicle headlight of the above-mentioned type to permit realization of further light functions, in particular, for curve or turning light applications, thereby simultaneously optimising costs and space.

SUMMARY OF THE INVENTION

This object is achieved in accordance with the invention by a vehicle headlight, wherein the second spiral-wound filament generates a turning and/or curve light and the regions of the reflector are separated by a separating line which extends in a segment of the reflector which is defined by an angle of between 0 and ±35 with respect to the vertical line. This separating line has technical advantages compared to a horizontal separation, in particular, for turning lights where the generated light beams are to be emitted sidewardly (in a vehicle, away from the longitudinal axis of the vehicle and towards the vehicle sides). Such radiation is difficult to generate if the individual reflector regions are separated horizontally. The separating line may thereby extend e.g. in two quadrants lying one above the other and be bent e.g. in the region of the center of the reflector. Alternatively, the separating line may also extend in two diagonally opposite quadrants, either with or without a bend. The separating lines may also extend in a curved manner. The separating line preferably passes through the reflector apex.

For a headlight installed in a vehicle, the region of the reflector for the second light function, i.e. the turning light, may be disposed closer to the longitudinal axis of the vehicle than the region of the reflector for the first light function. This arrangement is advantageous due to the curvature of the reflector, since the outer region is unfavourable due to deflection of the light from the light source via the reflector for the turning light, which should preferably be emitted in the direction of the respective side of the lane. The reflector can be designed such that when the inner reflector half is used, the light can be sidewardly emitted towards the sides of the lane which are then illuminated by this static turning light, without curve tracking, through simple optical deflection of the light source by the reflector. The turning light of the left-hand headlight emits light towards the left-hand side and the turning light of the right-hand headlight can emit light towards the right-hand edge of the lane. Configurations with pivotable curve light can in principle be realized, wherein either the entire reflector or merely the reflector region associated with the curve light can be pivoted to adjust the light to the shape of the curve. The pivot angle may thereby be determined either in dependence on the turning of the wheels or of the steering wheel.

The other reflector half may thereby be used e.g. for the high beam and/or fog light.

A shutter or covering cap is preferably disposed on the side of the second light source next to the spiral-wound filament, i.e. the curve or turning light, to extend in a substantially vertical direction for preventing impingement of light beams emitted by the turning light, spiral-wound filament onto the reflector half used for the high beam, the fog light or the first light function, which would otherwise blind approaching vehicles e.g. if the high beam is the first light function, even though the high beam is switched off.

If the first spiral-wound filament is in operation to generate a first light function, e.g. high beam or fog light, both reflector halves may be used by the first spiral-wound filament to generate the first light function and obtain the required illumination values. This permits, in particular, illumination of the overall relevant region in a technically straightforward manner. The spiral-wound filament for the turning light may also be used (i.e. both spiral-wound filaments) for the first light function.

Alternatively, only the spiral-wound filament for the high beam or the first light function may be used for the first light function.

The spiral-wound filament for the second light function, i.e. for the curve or turning light, may thereby be disposed on the optical axis and, as viewed in the light radiation direction, behind the spiral-wound filament for the first light function. In principle, one or both spiral-wound filament(s)

may be disposed on an axis extending parallel to the optical axis, however, offset therefrom.

The two spiral-wound filaments can be adjusted relative to the focus of the reflector or of the reflector halves.

Further advantages and features can be extracted from the remaining application documents.

The invention is explained in more detail below with reference to the drawing.

DESCRIPTION OF THE PREFERRED EMBODIMENT

Figure 1:
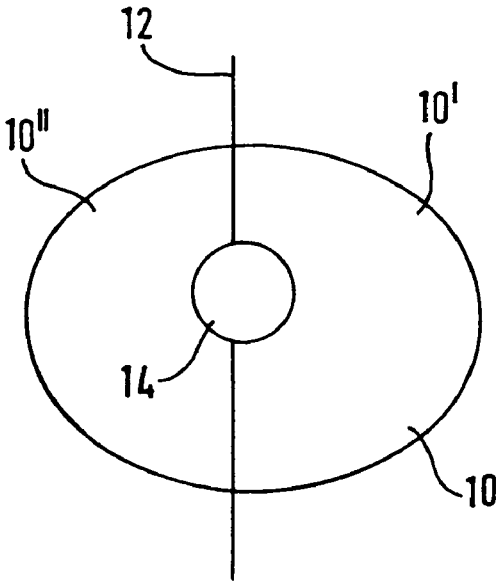
FIG. 1 shows a schematic front view of the headlight.

FIG. 1 shows a highly schematic front view of a section of a headlight. The headlight has a reflector 10 which is divided along an approximately vertical separating line 12 into two regions 10' and 10". The two regions 10' and 10" thereby differ with regard to their optical design and their radiation characteristics. The region 10' generates the high beam and the region 10" generates a turning beam. The figures shows a left-hand headlight of a motor vehicle. A two-filament bulb 14 is disposed on an optical axis 20 of the headlight and comprises two spiral-wound filaments 14' and 14" (see FIG. 2).

Figure 2:
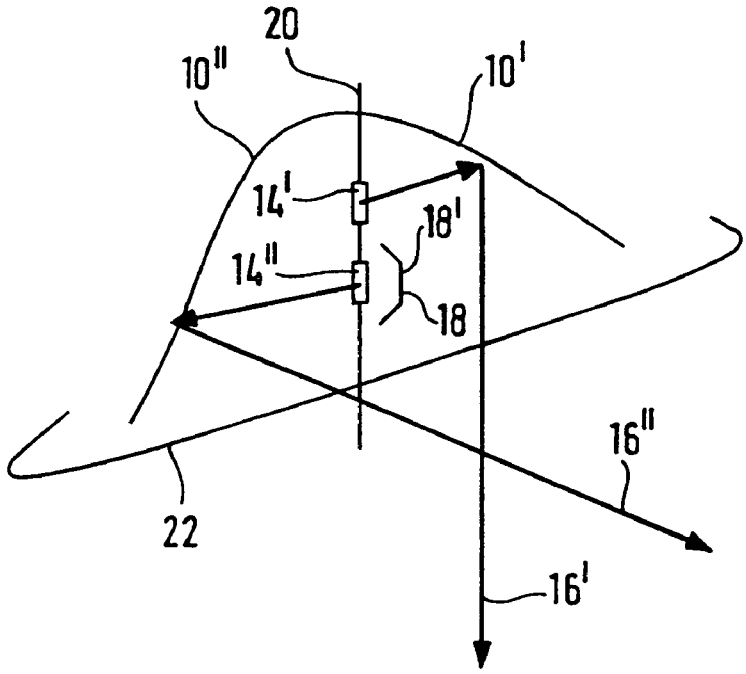
FIG. 2 shows a top view onto a left-hand headlight.

As viewed in the light radiation direction, the second spiral-wound filament is disposed behind the first one. FIG. 2 also shows that the reflector regions 10' and 10" have different shapes and curvatures with different associated optical characteristics. The region 10" serves for radiation of a turning light which, as explained above, is generated by the spiral-wound filament 14". As mentioned above, the headlight is the left-hand headlight of a motor vehicle, i.e. the reflector half 10" is that reflector half which is disposed closer to the longitudinal axis of the vehicle, for the generation of light which is radiated sidewardly onto the edge of the lane. The reflector region 10' generates the high beam, wherein this high beam is herein generated using the spiral-wound filament 14' only to radiate light onto both reflector regions 10' and 10", thereby producing the light function for high beam using both reflector regions 10' and 10". The high beam is characterized with 16' and the light beam for the turning light is characterized with 16".

A covering cap 18 or a shutter is disposed substantially vertically about the spiral-wound filament 14" to largely prevent light from impinging on the reflector surface 10'. In this manner, light from the spiral-wound filament 14" of the turning light function does not impinge on the reflector region 10' of the high beam light function thereby avoiding blinding approaching vehicles.

The headlight is closed at the front by a cover plate 22 disposed, as viewed in the light radiation direction, downstream of the second spiral-wound filament 14". The plate 22 may be transparent or alternatively comprise optical means for further alteration and modification of the light radiation characteristics.

Figure 3:
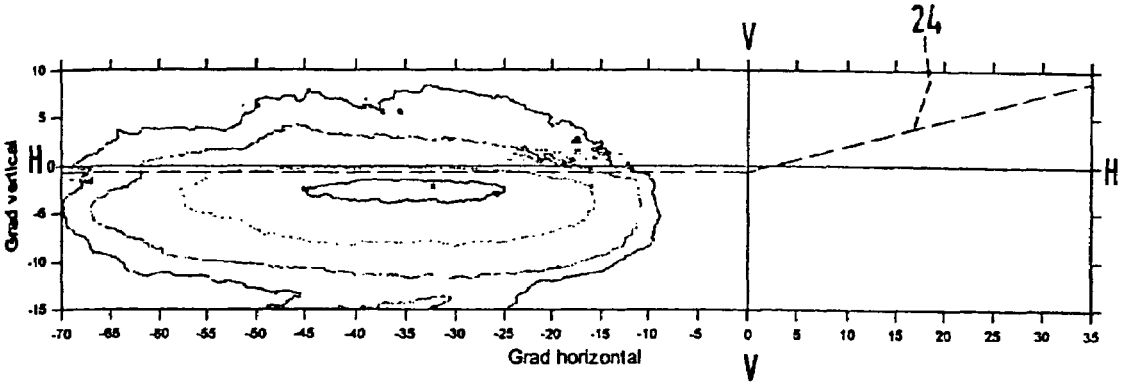
FIG. 3 shows a light distribution of the curve or turning light.

FIG. 3 shows the light radiation characteristics of the turning light, i.e. an illustration of the turning light on a measuring screen showing the lines V-V and H-H which define the vertical and horizontal central planes. The light/dark border for the low beam, which can be generated by another headlight, is marked with dotted lines and designated by 24. The light/dark border thereby extends approximately 1° below the horizontal central plane H-H in the region of the first and fourth quadrant. In the region of the second quadrant it rises at an angle of 15° with respect to the horizontal central plane as it passes through the vertical central plane.

The light distribution of the turning light is clearly displaced from the center, i.e. the point of intersection between the horizontal and vertical central planes, which is designated by HV, and is located between approximately 15° and approximately 70° (horizontally) within the fourth quadrant relative to the maximum. Due to this configuration, the left-hand edge of the lane or the road is more illuminated, in particular, for left-hand curves.

Figure 4:
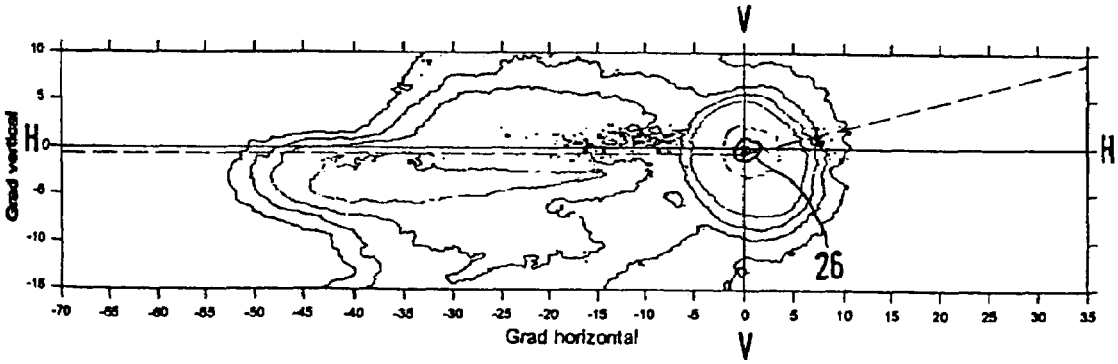
FIG. 4 shows a light distribution of the high beam.

FIG. 4 shows the corresponding representation of the measuring screen for the high beam, wherein the maximum light distribution is thereby disposed around the point HV, as indicated by the field 26.

This configuration and interplay between a turning light and a high beam improves utilization of the space available in a headlight housing thereby providing a solution for a static turning light which can be realized with little cost and with simple technical means.

The right-hand headlight has the same, mirror-symmetric, design.

We claim:

1. A vehicle headlight comprising:

a reflector, said reflector having a first region for a first light function and a second region for a second light function, said first region and said second region having a common border defined by a separating line, said separating line extending in a segment of said reflector at an angle of between 0° to ±35° with respect to vertical, when the headlight is installed in the vehicle;

a bulb having a first spiral-wound filament and a second spiral-wound filament, said first filament communicating with said first reflector region for generating said first light function, said second filament communicating with said second reflector region for generating said second light function, wherein said second light function defines a turning or a curve light; and a covering cap disposed to shield a portion of light emanating from said second filament which would otherwise impinge on said first reflector region, wherein said second region of said reflector is closer to a central longitudinal axis of the vehicle, when the headlight is installed in the vehicle, than said first region of said reflector.

2. The vehicle headlight of claim 1, wherein said angle is between ±(15° to 35°).

3. The vehicle headlight of claim 1, wherein said first spiral-wound filament generates at least one of a high beam, a fog light, a low beam, or part of a low beam.

4. The vehicle headlight of claim 1, wherein said second spiral-wound filament for said second light function is disposed, as seen in a light radiation direction, on an optical axis downstream of said first spiral-wound filament for said first light function.

5. The vehicle headlight of claim 1, wherein said first light function is generated by both said first and said second regions of said reflector.

6. The vehicle headlight of claim 1, wherein said covering cap is vertically disposed, when the headlight is installed in the vehicle.

7. The vehicle headlight of claim 1, wherein said first reflector region is one of paraboloid, ellipsoid or other shaped region in dependence on a light function to be realized thereby.

8. The vehicle headlight of claim 1, wherein said second reflector region is one of paraboloid, ellipsoid or other shaped region in dependence on a light function to be realized thereby.

9. The vehicle headlight of claim 7, wherein said first region of said reflector has a different shape than said second region of said reflector.

10. The vehicle headlight of claim 8, wherein said first region of said reflector has a different shape than said second region of said reflector.

11. The vehicle headlight of claim 1, wherein said separating line extends in two quadrants of said reflector which are disposed one above an other.

12. The vehicle headlight of claim 1, wherein said separating line extends in two diagonally opposite quadrants of said reflector.

* * * * *